US010704555B2

(12) United States Patent
Sakaguchi et al.

(10) Patent No.: US 10,704,555 B2
(45) Date of Patent: Jul. 7, 2020

(54) STATOR-SIDE MEMBER AND VACUUM PUMP

(71) Applicant: Edwards Japan Limited, Yachiyo-shi, Chiba (JP)

(72) Inventors: Yoshiyuki Sakaguchi, Yachiyo (JP); Akihiro Ito, Yachiyo (JP); Yoshinobu Ohtachi, Yachiyo (JP); Yasushi Maejima, Yachiyo (JP); Tsutomu Takaada, Yachiyo (JP)

(73) Assignee: Edwards Japan Limited, Yachiyo-shi (JP)

( * ) Notice: Subject to any disclaimer, the term of this patent is extended or adjusted under 35 U.S.C. 154(b) by 191 days.

(21) Appl. No.: 14/422,173

(22) PCT Filed: Aug. 26, 2013

(86) PCT No.: PCT/JP2013/072666
§ 371 (c)(1),
(2) Date: Feb. 17, 2015

(87) PCT Pub. No.: WO2014/038416
PCT Pub. Date: Mar. 13, 2014

(65) Prior Publication Data

US 2015/0240822 A1 Aug. 27, 2015

(30) Foreign Application Priority Data

Sep. 6, 2012 (JP) ..... 2012-196290

(51) Int. Cl.
*F04D 19/04* (2006.01)
*F04D 29/02* (2006.01)
(Continued)

(52) U.S. Cl.
CPC ..... *F04D 19/042* (2013.01); *F04D 19/044* (2013.01); *F04D 29/023* (2013.01);
(Continued)

(58) Field of Classification Search
CPC ..... F04D 19/04; F04D 19/042; F04D 19/044; F04D 19/5853; F04D 29/023
See application file for complete search history.

(56) References Cited

U.S. PATENT DOCUMENTS 4,797,062 A * 1/1989 Deters ..... F04D 19/04 415/177
4,929,151 A * 5/1990 Long ..... F04D 29/584 415/177
(Continued)

FOREIGN PATENT DOCUMENTS

EP 1156223 A1 11/2001
JP H01219393 9/1989
(Continued)

OTHER PUBLICATIONS

Engineering Toolbox "Thermal Conductivity of Common Materials and Gases," retrieved from http://www.engineeringtoolbox.com/thermal-conductivity-d_429.html on Feb. 2, 2017.*
(Continued)

*Primary Examiner* — Michael Lebentritt
*Assistant Examiner* — Topaz L. Elliott
(74) *Attorney, Agent, or Firm* — Shumaker & Sieffert, P.A.

(57) ABSTRACT

The invention provides a stator-side member which is arranged in a vacuum pump and which, without the provision of a heat insulation material, prevents the deposition of products at the lower side of a threaded groove pump unit, with this lower side being an area of high pressure where the deposition of products (deposits) occurs easily, and also provides a vacuum pump equipped with this stator-side member. A threaded groove spacer configured to have a coefficient of thermal conductivity lower than a predetermined value is arranged in a vacuum pump equipped with a threaded groove pump unit. (1) The threaded groove spacer
(Continued)

is manufactured from a material having a coefficient of thermal conductivity lower than that of a member which opposes or comes into contact with the threaded groove spacer. Specifically, this material has a coefficient of thermal conductivity lower than that of aluminum or aluminum alloy, and is preferably any one of stainless steel, fiber-reinforced plastic, polyetherimide, and polyetheretherketone. (2) The threaded groove spacer is constituted by at least two or more parts.

20 Claims, 7 Drawing Sheets

(51) Int. Cl.
*F04D 29/54* (2006.01)
*F04D 29/58* (2006.01)
*F04D 29/38* (2006.01)

(52) U.S. Cl.
CPC ..... *F04D 29/38* (2013.01); *F04D 29/542* (2013.01); *F04D 29/58* (2013.01); *F04D 29/5853* (2013.01); *F05B 2260/231* (2013.01); *F05B 2280/1021* (2013.01); *F05B 2280/1071* (2013.01); *F05B 2280/4008* (2013.01); *F05B 2280/4009* (2013.01); *F05B 2280/6003* (2013.01); *F05D 2300/121* (2013.01); *F05D 2300/171* (2013.01); *F05D 2300/173* (2013.01); *F05D 2300/434* (2013.01); *F05D 2300/436* (2013.01); *F05D 2300/5024* (2013.01); *F05D 2300/603* (2013.01)

(56) References Cited

U.S. PATENT DOCUMENTS

| | | | | |
|---|---|---|---|---|
| 5,577,883 | A * | 11/1996 | Schutz | F04D 19/04 415/177 |
| 6,589,009 | B1 | 7/2003 | Shiokawa et al. | |
| 6,599,108 | B2 * | 7/2003 | Yamashita | F04D 19/04 417/313 |
| 6,793,466 | B2 * | 9/2004 | Miyamoto | F04D 29/584 415/177 |
| 6,814,536 | B2 * | 11/2004 | Sakaguchi | F04D 19/04 415/174.4 |
| 6,824,349 | B2 * | 11/2004 | Okudera | F04D 29/601 415/143 |
| 6,851,848 | B2 * | 2/2005 | Miwata | F04D 19/04 374/120 |
| 6,887,032 | B2 * | 5/2005 | Favre-Felix | F04D 29/023 242/437 |
| 6,926,493 | B1 * | 8/2005 | Miyamoto | F04D 19/042 415/143 |
| 2003/0095861 | A1 | 5/2003 | Sakaguchi et al. | |
| 2003/0129053 | A1 | 7/2003 | Nonaka et al. | |
| 2003/0175131 | A1 * | 9/2003 | Ishikawa | F04D 19/04 417/353 |
| 2012/0207592 | A1 * | 8/2012 | Tsutsui | F04D 29/388 415/200 |
| 2013/0045094 | A1 * | 2/2013 | Giors | F04D 19/042 415/200 |
| 2018/0335052 | A1 * | 11/2018 | Sakaguchi | F04D 19/04 |
| 2018/0363662 | A1 * | 12/2018 | Kabasawa | F04D 17/168 |

FOREIGN PATENT DOCUMENTS

| | | | | |
|---|---|---|---|---|
| JP | 07-004384 | | 1/1995 | |
| JP | 09310696 | A * | 12/1997 | |
| JP | 2001032789 | | 2/2001 | |
| JP | 2002-303293 | | 10/2002 | |
| JP | 2003172290 | | 6/2003 | |
| JP | 2004-116319 | | 4/2004 | |
| JP | 2006-037951 | | 2/2006 | |
| KR | 20120115204 | A * | 10/2012 | F04D 19/044 |
| WO | 2011070856 | A1 | 6/2011 | |
| WO | 2011092674 | A1 | 8/2011 | |

OTHER PUBLICATIONS

"Victrex PEEK" retreived from https://www.victrex.com/~/media/datasheets/victrex_tds_90g.pdf on Feb. 2, 2017.*
English translation of JPH09310696.*
English translation of JPH074384.*
English translation of JP2001032789.*
English translation of JP2003172290.*
English translation of KR 20120115204.*
Machine translation of WO 2011/070856 (Year: 2019).*
Extended Search Report from counterpart European Application No. 13835610.0, dated Mar. 17, 2016, 9 pp.
Translation of the International Search Report dated Dec. 3, 2013 in counterpart PCT Application No. PCT/JP2013/072666, 4 pgs.
Communication pursuant to Article 94(3) EPC from counterpart European Application No. 13835610.0, dated Feb. 3, 2017, 7 pp.

* cited by examiner

STATOR-SIDE MEMBER AND VACUUM PUMP

This application is a national stage entry under 35 U.S.C. § 371 of International Application No. PCT/JP2013/072666, filed Aug. 26, 2013, which claims the benefit of JP Application 2012-196290, filed Sep. 6, 2012. The entire contents of International Application No. PCT/JP2013/072666 and JP Application 2012-196290 are incorporated herein by reference.

TECHNICAL FIELD

The present invention relates to a stator-side member and a vacuum pump equipped with the stator-side member.

BACKGROUND

Among the various vacuum pumps that are frequently used to realize a high vacuum environment are turbo-molecular pumps and threaded groove pumps.

Also amongst the vacuum apparatuses that are kept vacuum inside by the execution of an exhaust treatment using vacuum pumps such as turbo-molecular pumps or threaded groove pumps are chambers for semiconductor manufacturing apparatuses, electron microscope test chambers, surface analysis apparatuses, and micro-machining apparatuses.

Those vacuum pumps for realizing a high vacuum environment each have a casing that configures a casing equipped with an inlet port and an outlet port. A structure that brings about the exhaust function of such a vacuum pump is stored in the casing. The structure that brings about the exhaust function is constructed mainly with a rotating portion (a rotor portion) pivotally supported in a rotatable manner and a fixed portion (a stator portion) fixed with respect to the casing.

In a turbo-molecular pump, the rotating portion thereof is constituted by a rotating shaft and a rotating body fixed to this rotating shaft, wherein a plurality of stages of radial rotor blades (moving blades) are arranged in the rotating body. Also, a plurality of stator blades (stationary blades) are arranged alternately with the rotor blades, in the fixed portion.

In addition, a motor for rotating the rotating shaft at high speeds is provided. Rotating the rotating shaft at high speeds by the motor causes the interaction between the rotor blades and the stator blades to draw a gas from the inlet port and discharge the gas from the outlet port.

Incidentally, these vacuum pumps such as turbo-molecular pumps and threaded groove pumps are each configured to introduce from the inlet port an exhaust gas that contains particles generated within a vacuum container (e.g., particles of several μ to several hundred μm), such as fine particles of reaction products generated in, for example, a chamber for a semiconductor manufacturing apparatus.

Some of the steps executed by the vacuum apparatus arranged in such a vacuum pump inevitably cause such suspended matters called particles to adhere in the form of products (deposits) on the inside of the vacuum pump. Moreover, in some cases the exhaust gas to be discharged as described above turns into a solid product in accordance with a sublimation curve (vapor pressure curve). The deposition and solidification of products are likely to occur especially in the vicinity of the outlet port where the pressure of the gas increases.

Although any problems might not occur while the vacuum pump is rotated, the gas remaining in the vacuum pump becomes cold as soon as the rotation of the vacuum pump is stopped, leading to a growth of the products and resulting in adhesion of the rotating body of the vacuum pump and the products.

Accumulation of the products in the vicinity of the outlet port narrows the gas flow path and increases the backpressure. As a result, the exhaust performance of the vacuum pump deteriorates significantly.

The rotating body of the vacuum pump is generally manufactured from a metallic material such as aluminum or an aluminum alloy and normally rotates at 20,000 rpm to 90,000 rpm. The peripheral velocity thereof at the edges of the rotor blades reaches 200 m/s to 400 m/s. This configuration causes the thermal expansion of the rotor portion of the vacuum pump (the rotor blades in particular) and the creep phenomena in which the rotor portion becomes deformed in the radial direction over time. The thermal expansion and creep phenomena of the vacuum pump are more prominent at the lower side of the rotating body (the outlet port side) than the upper side (the inlet port side), bringing the expanded rotating body into contact with the deposited products at the outlet port side in particular.

In a case where the apparatus arranged in the vacuum pump is a chamber for a semiconductor manufacturing apparatus, because the main raw material of the semiconductor manufacturing wafer is silicon, the deposited products might become harder than the rotating body manufactured from aluminum or an aluminum alloy. When the products come into contact with the rotating body that rotates at high speeds as described above, the rotating body with a lower hardness breaks, which, in the worst-case scenario leads to a breakdown of the vacuum pump.

When part of the vacuum pump comes into contact with the products deposited in the vicinity of the outlet port where the pressure or temperature of the gas is high, as described above, problems such as deterioration of the performance of the vacuum pump and damage to the rotor blades occur in the vacuum pump. In order to remove the adhered products, an overhaul needs to take place on a regular basis in which the apparatus is disassembled before being thoroughly cleaned.

SUMMARY

For the purpose of preventing the deposition of products that are generated as a result of condensation of gas as described above, there has been proposed a conventional technique for keeping the temperature that prevents the products from becoming solid by heating the outer wall or stationary wall (stator portion) of a casing with a heater wrapped around the casing.

Japanese Patent Application Laid-open No. H09-310696 discloses a molecular pump for preventing the condensation and deposition of a process gas in an exhaust path of an exhaust internal pipe by heating the exhaust internal pipe at 120 degrees with a heater installed around the exhaust internal pipe. A technique for adiabatically locking a stator by arranging a heat insulation material has also been disclosed.

However, the configuration described in Japanese Patent Application Laid-open No. H09-310696 in which the heater is installed around the exhaust internal pipe causes a problem associated with the wiring of the heater in a vacuum pump that needs to be kept vacuum inside. Another problem of this configuration is that the heater does not heat the gas that needs to be heated directly, lowering the heating efficiency.

The technique that uses a heat insulation material is now described below.

FIG. 7 is a general view for illustrating an example of a conventional vacuum pump 500 that uses a heat insulation material 90.

As shown in FIG. 7, this conventional technique achieves a heat insulating effect by arranging the heat insulation material 90 on a contact surface of the vacuum pump 500 where the heat escapes (e.g., a contact surface between an internal thread portion 67 and a base 3), and keeps the temperature that prevents solidification of products in the vacuum pump 500, by increasing the temperature of the vacuum pump to a predetermined temperature by taking advantage of the rising of the internal temperature of the vacuum pump (the self-temperature rising characteristics).

Unfortunately, the conventional technique using the heat insulation material 90 has the following problems. In other words, the vicinity of the contact surface between the internal thread portion 67 and the base 3, which is an example of the location for arranging the heat insulation material 90, is designed with a clearance (gap) that is too narrow for the vacuum pump 500. For this reason, the tolerance (dimensional tolerance) increases by a dimensional difference of the heat insulation material 90 to be arranged, resulting in more dimensional fluctuations in assembly of the vacuum pump. Specifically, compared to when the heat insulation material 90 is not used, the use of the heat insulation material 90 causes a problem that fluctuations in the design occur more easily in assembly of the vacuum pump 500. The use of the heat insulation material 90 also results in an increase in the number of parts of the vacuum pump 500, hence the number of operation steps and the number of assembly steps.

An object of the present invention is to provide a stator-side member that is arranged in a vacuum pump and prevents the deposition of products at a section of the vacuum pump where the deposition of products occurs easily, (i.e., at the lower side of a threaded groove pump unit where the pressure is high and the accumulation of deposits occurs easily), without being affected by dimensional fluctuations in assembly of the vacuum pump and without increasing the number of operation steps, and to provide the vacuum pump equipped with this stator-side member.

In order to achieve this object, an invention of the present application according to claim 1 provides a stator-side member used in a first gas transfer mechanism of a vacuum pump, the stator-side member including: a casing in which an inlet port and an outlet port are formed; a stator portion that is arranged inside the casing; a rotating shaft that is contained in the casing and pivotally supported in a rotatable manner; and a rotating body that is fixed to the rotating shaft, wherein the stator-side member is manufactured from a first member having a coefficient of thermal conductivity lower than that of a second member, which comes into contact with the stator-side member, out of the casing and the stator portion.

An invention of the present application according to claim 2 provides the stator-side member described in claim 1, wherein the first member is a member having a coefficient of thermal conductivity lower than that of a third member, which opposes the stator-side member, of the rotating body.

An invention of the present application according to claim 3 provides the stator-side member described in claim 2, wherein the third member is aluminum or aluminum alloy.

An invention of the present application according to claim 4 provides the stator-side member described in claim 1, wherein the first member is stainless steel.

An invention of the present application according to claim 5 provides the stator-side member described in claim 1, wherein the first member is one of polyetherimide and polyetheretherketone.

An invention of the present application according to claim 6 provides the stator-side member described in claim 1, wherein the first member is fiber-reinforced plastic.

An invention of the present application according to claim 7 provides the stator-side member described in any of claims 1 to 6, wherein the stator-side member is constituted by at least two parts.

An invention of the present application according to claim 8 provides the stator-side member described in claim 7, wherein, a part that comes into contact with the second member out of the parts is manufactured from the first member.

An invention of the present application according to claim 9 provides the stator-side member described in claim 7 or 8, wherein, a part that opposes the third member out of the parts is manufactured from the first member.

An invention of the present application according to claim 10 provides the vacuum pump including the casing, the stator portion, the rotating shaft, the rotating body, and the stator-side member, which are described in claim 1

An invention of the present application according to claim 11 provides the vacuum pump described in claim 10, further comprising a second gas transfer mechanism that has rotor blades arranged radially from an outer circumferential surface of the rotating body and stator blades arranged in such a manner as to protrude from an inner side surface of the stator portion toward the rotating shaft, and transfers a gas suctioned from the inlet port to the outlet port by taking advantage of an interaction between the rotor blades and the stator blades.

The present invention can provide a stator-side member which is arranged in a vacuum pump and which, without the provision of a heat insulation material, prevents the deposition of products, and the vacuum pump equipped with this stator-side member.

DETAILED DESCRIPTION

(i) Brief Summary of Embodiments

A vacuum pump according to the embodiments of the present invention is equipped with a threaded groove pump unit and configured in such a manner that the coefficient of thermal conductivity of a threaded groove spacer (a stator-side member of the threaded groove pump unit) arranged in the vacuum pump is smaller than a predetermined value.

(ii) Details of Embodiments

Preferred embodiments of the present invention are described hereinafter in detail with reference to FIGS. 1 to 6.

Note that the first embodiment describes, as an example of the vacuum pump, a so-called composite turbo-molecular pump with a turbo-molecular pump unit (the second gas transfer mechanism) and a threaded groove pump unit (the first gas transfer mechanism).

(ii-1) First Embodiment

Figure 1:
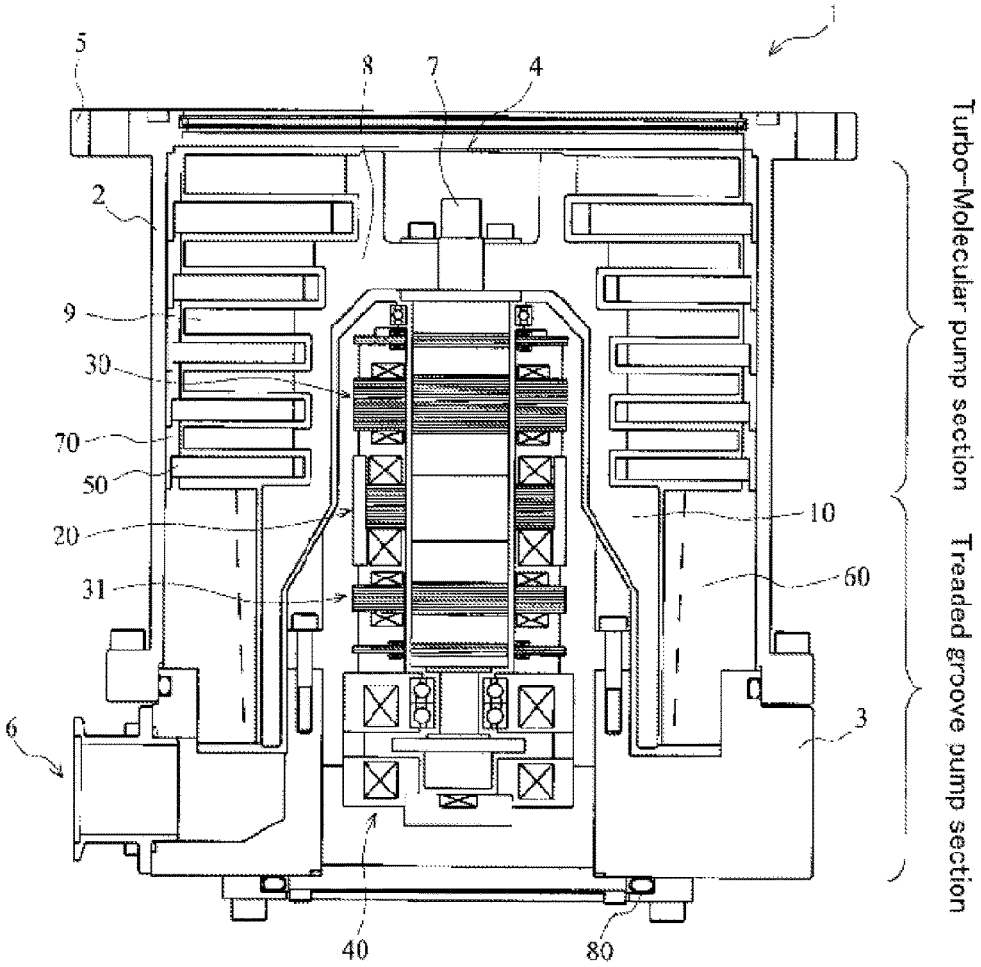
FIG. 1 is a diagram showing an example of the schematic configuration of a turbo-molecular pump according to a first embodiment of the present invention.

FIG. 1 is a diagram showing an example of the schematic configuration of a turbo-molecular pump 1 according to the first embodiment of the present invention. Note that FIG. 1 shows a cross-sectional diagram of the turbo-molecular pump 1 along an axial direction.

A casing 2 that forms a casing of the turbo-molecular pump 1 is in a substantially cylindrical shape and configures a housing of the turbo-molecular pump 1 along with a base 3 provided at a lower part of the casing 2 (the outlet port 6 side). The inside of the housing is a gas transfer mechanism which is a structure for bringing about the exhaust function of the turbo-molecular pump 1.

This gas transfer mechanism is constructed mainly with a rotating portion that is pivotally supported in a rotatable manner, and a stator portion fixed with respect to the housing.

An inlet port 4 for introducing a gas to the turbo-molecular pump 1 is formed at an edge of the casing 2. A flange portion 5 is formed on an end surface of the casing 2 on the inlet port 4 side in such a manner as to protrude toward an outer circumference.

Furthermore, the outlet port 6 for discharging the gas from the turbo-molecular pump 1 is formed on the base 3.

The rotating portion is constituted by a rotating shaft 7, a rotor 8 arranged on the shaft 7, a plurality of rotor blades 9 provided on the rotor 8, a tubular rotating member 10 provided on the outlet port 6 side (the threaded groove pump unit), and the like. A rotor portion is configured by the shaft 7 and the rotor 8.

Each of the rotor blades 9 extends radially from the shaft 7 while tilting at a predetermined angle from a flat plane perpendicular to the axis line of the shaft 7.

The tubular rotating member 10 is formed from a cylindrical member concentric with the axis of rotation of the rotor 8.

A motor portion 20 for rotating the shaft 7 at high speeds is provided in the middle of the axial direction of the shaft 7.

In addition, radial magnetic bearing devices 30, 31 for pivotally supporting the shaft 7 in a radial direction in a non-contacting manner are provided on the inlet port 4 side and the outlet port side 6 with respect to the motor portion 20 of the shaft 7. An axial magnetic bearing device 40 for axially supporting the shaft 7 in the axial direction in a non-contacting manner is provided at a lower end of the shaft 7.

The stator portion is formed on the inner circumferential side of the housing. The stator portion is constituted by a plurality of stator blades 50 provided on the inlet port 4 side (the turbo-molecular pump unit), a threaded groove spacer 60 provided on an inner circumferential surface of the casing 2, and the like.

Each of the stator blades 50 is configured from a blade that extends toward the shaft 7 from the inner circumferential surface of the housing while tilting at a predetermined angle from the flat plane perpendicular to the axis line of the shaft 7.

The stages of stator blades 50 are fixed while being spaced apart by cylindrical spacers 70.

In the turbo-molecular pump unit, a plurality of stages of the stator blades 50 and the rotor blades 9 are arranged alternately along the axial direction.

The threaded groove spacer 60 has a spiral groove that is formed on each of the surfaces facing the tubular rotating member 10. The threaded groove spacer 60 faces an outer circumferential surface of the tubular rotating member 10 with a predetermined clearance therebetween. When the tubular rotating member 10 rotates at high speed, a gas compressed by the turbo-molecular pump 1 is sent toward the outlet port 6 side by being guided along the threaded grooves (the spiral grooves) as the tubular rotating member 10 rotates. In other words, the threaded grooves configure a flow path for transporting the gas. The gas transfer mechanism (the first gas transfer mechanism) for transferring the gas along the threaded grooves is configured by providing the threaded groove spacer 60 to face the tubular rotating member 10 with a predetermined clearance therebetween.

Note that the narrower the clearance, the better, in order to reduce the force of the gas flowing backwards toward the inlet port 4 side.

The spiral grooves formed in the threaded groove spacer 60 is directed toward the outlet port 6 side when the gas is transported along the spiral grooves in the direction of rotation of the rotor 8.

The spiral grooves are also formed so as to become shallower toward the outlet port 6, and the gas to be transported along the spiral grooves is compressed more toward the outlet port 6. According to this configuration, the gas suctioned from the inlet port 4 is compressed by the turbo-molecular pump (the second gas transfer mechanism), further compressed by the threaded groove pump unit (the first gas transfer mechanism), and then discharged from the outlet port 6.

Furthermore, in a case where the turbo-molecular pump 1 is used for manufacturing a semiconductor, a number of steps for causing various process gasses to act on a semiconductor substrate are executed in order to manufacture a semiconductor, wherein the turbo-molecular pump 1 is used not only for keeping the inside of the chamber vacuum but also for discharging the process gasses from the chamber.

These process gasses not only have the pressures thereof increased when discharged, but also become solid at a certain temperature when cooled, causing the deposition of products in the exhaust system.

When these types of process gasses become solid at low temperature in the turbo-molecular pump 1 and adhere/accumulate in the turbo-molecular pump 1, the accumulated products narrows the pump flow path, contributing to a degradation of the performance of the turbo-molecular pump 1.

In order to prevent this situation, a temperature sensor (not shown) such as a thermistor is embedded in the base 3, and heating by a heater (not shown) and cooling by a water-cooled pipe 80 are controlled (TMS: Temperature Management System) to keep the temperature of the base 3 at a certain high temperature (set temperature) based on a signal from the temperature sensor.

Here, the water-cooled pipe 80 is arranged in the vicinity of the lower part of the base 3, for example, in order to cool the members that are heated up by the high-speed rotation.

The turbo-molecular pump 1 configured as described above executes an evacuation process of a vacuum chamber (not shown) arranged in the turbo-molecular pump 1.

The turbo-molecular pump 1 according to the first embodiment of the present invention has the threaded groove spacer 60 in the threaded groove pump unit, which has a coefficient of thermal conductivity lower than a predetermined value. The predetermined value is described hereinafter.

In the first embodiment of the present embodiment, the water-cooled pipe 80 is arranged in the vicinity of the lower side of the threaded groove spacer 60 with the base 3 therebetween, thereby releasing the heat at the lower side of the threaded groove spacer 60 toward the base 3 in particular. In the first embodiment of the present invention, therefore, the threaded groove spacer 60 of the turbo-molecular pump 1 is manufactured from, for example, a material that has a coefficient of thermal conductivity lower than that of the base 3 coming into contact with the threaded groove spacer 60.

Additionally, in the first embodiment of the present invention, the threaded groove spacer 60 of the turbo-molecular pump 1 is manufactured from a material that has a coefficient of thermal conductivity lower than that of the tubular rotating member 10 opposing the threaded groove spacer 60.

In the first embodiment of the present invention, the tubular rotating member 10 of the turbo-molecular pump 1 is produced from, for example, aluminum or an aluminum alloy. Therefore, in the first embodiment of the present invention, the threaded groove spacer 60 facing the tubular rotating member 10 is manufactured from a material having a coefficient of thermal conductivity lower than that of aluminum or an aluminum alloy, the material of the tubular rotating member 10. Specifically, the threaded groove spacer 60 according to the first embodiment of the present invention is manufactured from a material having a coefficient of thermal conductivity lower than that of aluminum which is generally 236 W/(m·K) (watt per meter-kelvin). More specifically, it is preferred that the material of the threaded groove spacer 60 according to the first embodiment of the present invention be, for example, stainless steel that generally has a coefficient of thermal conductivity of approximately 16.7 to 20.9 W/(m·K), fiber-reinforced plastic, polyetherimide (PEI) that generally has a coefficient of thermal conductivity of approximately 0.22 W/(m·K), or a resin material such as polyetheretherketone (PEEK) that generally has a coefficient of thermal conductivity of approximately 0.25 W/(m·K).

As to fiber-reinforced plastic, its specific coefficient of thermal conductivity is not mentioned here because the coefficient of thermal conductivity of fiber-reinforced plastic fluctuates depending on a combination of a parent substance (matrix) and fiber to produce fiber-reinforced plastic; however, in the first embodiment of the present invention, fiber-reinforced plastic that is created to have a coefficient of thermal conductivity lower than that of aluminum which is 236 W/(m·K) as described above can be used as the material of the threaded groove spacer 60.

In addition, the materials of the components arranged in the turbo-molecular pump 1 need to be characterized in releasing less emitted gas which is a gaseous component to be released into a vacuum. For this reason, it is preferred that the material of the threaded groove spacer 60 be characterized in not only having a low coefficient of thermal conductivity as described above, but also releasing less emitted gas and having excellent corrosion resistance.

In the turbo-molecular pump 1 according to the first embodiment of the present invention described above, the threaded groove spacer 60 is manufactured from a material having a coefficient of thermal conductivity lower than that of the base 3 that comes into contact with the threaded groove spacer 60. Furthermore, the threaded groove spacer 60 is manufactured from a material having a coefficient of thermal conductivity lower than that of the tubular rotating member 10 that opposes the threaded groove spacer 60.

Owing to such a configuration, the turbo-molecular pump 1 according to the first embodiment of the present invention prevents heat from conducting from the threaded groove spacer 60 to the base 3. As a result, the decrease in temperature of the threaded groove spacer 60 can be prevented, as well as the deposition and adhesion of products by promoting self-temperature rising of the threaded groove spacer 60.

Moreover, because a separate part such as a heat insulation material is not arranged in the turbo-molecular pump 1 according to the first embodiment of the present invention, the degradation of the assemblability or workability of the turbo-molecular pump 1 that is caused by an increase in the number of parts can be prevented.

(ii-2) Second Embodiment

Next, the second embodiment of the present invention is described with reference to FIG. 2.

Figure 2:
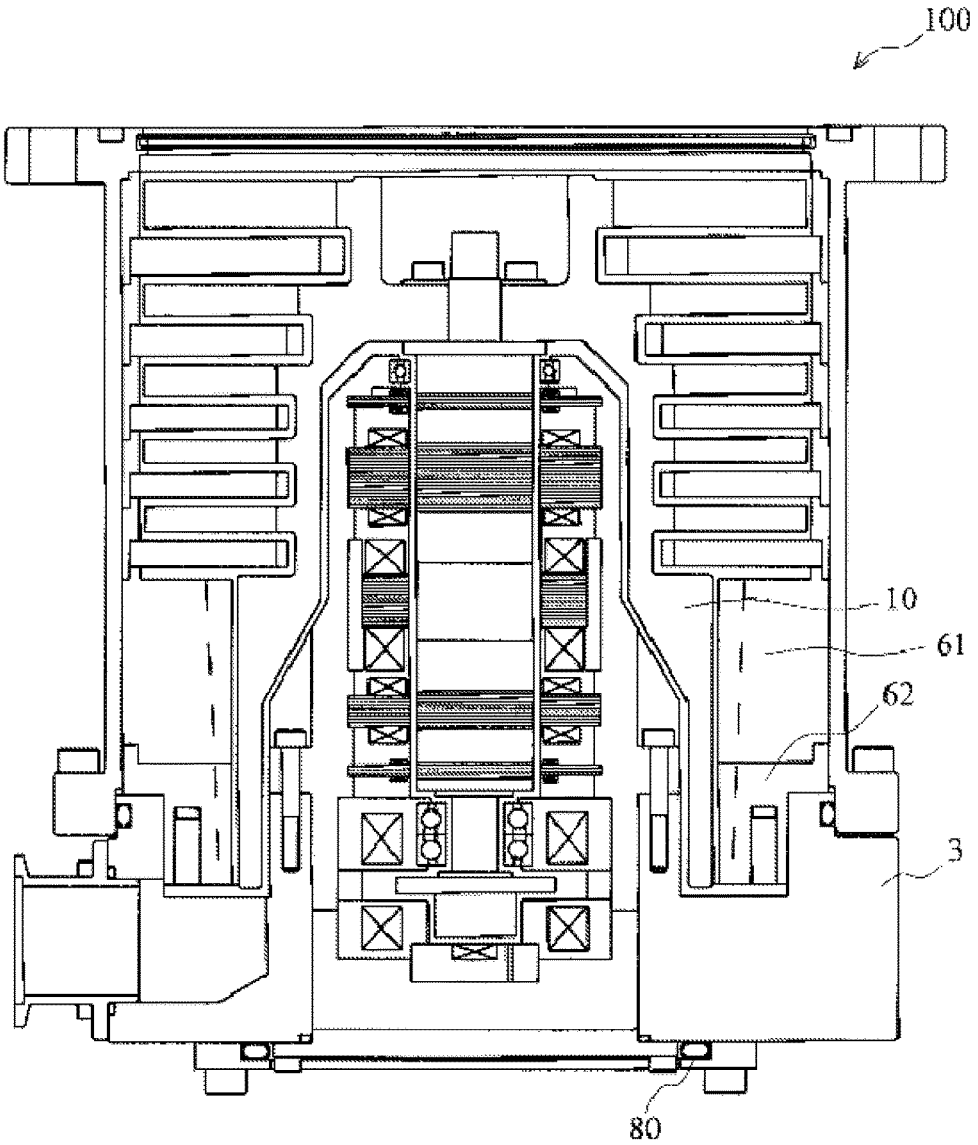
FIG. 2 is a diagram showing an example of the schematic configuration of a turbo-molecular pump according to a second embodiment of the present invention.

FIG. 2 is a diagram showing an example of the schematic configuration of a turbo-molecular pump 100 according to the second embodiment of the present invention. Note that FIG. 2 shows a cross-sectional diagram of the turbo-molecular pump 100 along the axial direction. The same configurations as those of the first embodiment of the present invention described above are omitted hereinafter.

In the second embodiment of the present invention, a threaded groove spacer arranged in the turbo-molecular pump 100 is constituted by a plurality of parts.

In the turbo-molecular pump 100 according to the second embodiment of the present invention, the threaded groove spacer to be configured by a plurality of parts is obtained by, for example, dividing the threaded groove spacer 60 of the first embodiment of the present invention in the radial direction (e.g., in the direction substantially perpendicular to the shaft 7), and arranging the resultant two parts: a threaded groove spacer 61 and a threaded groove spacer 62.

In such a configuration of the turbo-molecular pump 100 according to the second embodiment of the present invention where the two parts, the threaded groove spacer 61 and the threaded groove spacer 62, are arranged, a surface that comes into contact with the threaded groove spacer 61 and the threaded groove spacer 62 is created. As a result, heat cannot be conducted smoothly in the vicinity of the division surface (contact surface) formed by the threaded groove spacer 61 and the threaded groove spacer 62. In other words, because the efficiency of thermal conduction becomes lower than that obtained when constructing the threaded groove spacer with a single part, the heat that is emitted from the tubular rotating member 10 cannot be transmitted easily from the threaded groove spacer 61 to the threaded groove spacer 62, thus keeping the heat from escaping.

In this turbo-molecular pump 100 according to the second embodiment of the present invention, the threaded groove spacer is constituted by the two parts (the threaded groove spacer 61 and the threaded groove spacer 62).

Accordingly, because the efficiency of thermal conduction becomes lower a single threaded groove spacer, the turbo-molecular pump 100 according to the second embodiment of the present invention can not only prevent the decrease in temperature of the threaded groove spacer (the threaded groove spacer 61 and the threaded groove spacer 62), but also promote self-temperature rising of the threaded groove spacer (the threaded groove spacer 61 and the threaded groove spacer 62) and consequently prevent the deposition and adhesion of products.

In the second embodiment of the present invention, only the threaded groove spacer 62 may be replaced when an overhaul is executed, enabling the execution of an efficient overhaul.

Furthermore, of the plurality of parts configuring the threaded groove spacer, the part that comes into contact with the base 3 (the threaded groove spacer 62, in FIG. 2) may be manufactured from a material having a coefficient of thermal conductivity lower than a predetermined value.

The predetermined value mentioned here is the same as the one described in the first embodiment.

The number of parts for configuring the threaded groove spacer is not limited to two but may be three or more (not shown). In this case, of the three or more parts configuring the threaded groove spacer, for example, any of the parts in the vicinity of the base 3 may be manufactured from a material having a coefficient of thermal conductivity lower than the predetermined value. Alternatively, of the three or more parts, the part arranged in contact with the base 3 may be manufactured from a material having the lowest coefficient of thermal conductivity.

It should be noted that the predetermined value is the same as the one described in the first embodiment.

Because the use of a single threaded groove spacer leads to a decrease in the efficiency of thermal conduction, the turbo-molecular pump 100 according to the second embodiment of the present invention can not only prevent the decrease in temperature of the threaded groove spacer, but also promote self-temperature rising of the threaded groove spacer and consequently prevent the deposition and adhesion of products.

In addition, in the second embodiment of the present invention, when an overhaul is executed, it is only necessary to replace the part arranged in contact with the base 3 out of the plurality of parts, enabling the execution of an efficient overhaul.

(ii-2-1) Modification of the Second Embodiment

Next, a modification of the second embodiment of the present invention is described with reference to FIG. 3.

Figure 3:
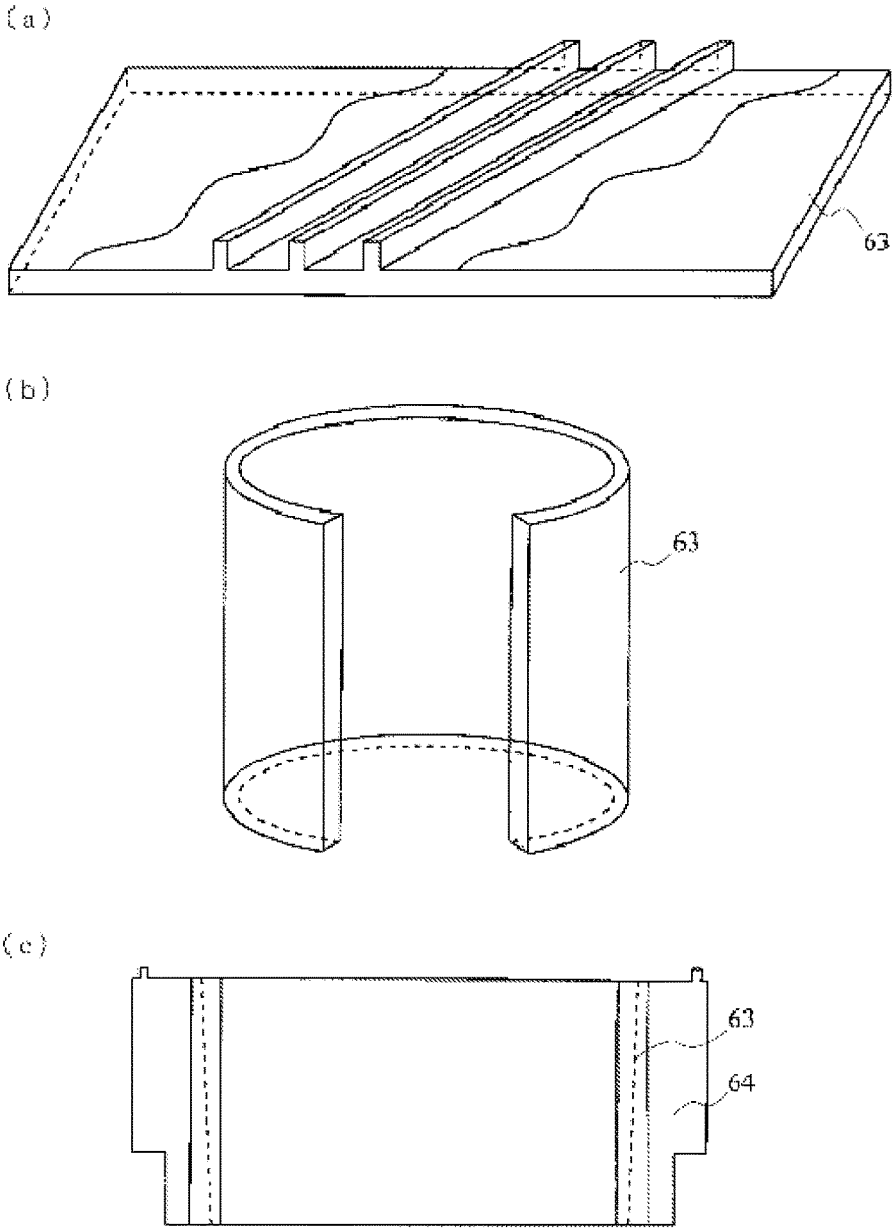
FIG. 3 is a diagram for illustrating a modification of the turbo-molecular pump according to the second embodiment of the present invention.

FIG. 3 is a cross-sectional diagram for illustrating a modification of the second embodiment of the present invention.

In the modification of the second embodiment of the present invention, a threaded groove spacer thereof to be configured by a plurality of parts has two parts, as shown in FIG. 3: a threaded groove spacer threaded groove exhaust portion 63 (i.e., a part a threaded groove) and a threaded groove spacer outer circumferential portion 64 (i.e., a part without a threaded groove).

More specifically, in the modification of the second embodiment of the present invention, the threaded groove spacer threaded groove exhaust portion 63 is formed into a plate as shown in FIG. 3A, then into a cylinder as shown in FIG. 3B, and then tightly fixed to the inside of the threaded groove spacer outer circumferential portion 64 as shown in FIG. 3C. Subsequently, this resultant component is constituted by these two parts (the threaded groove spacer threaded groove exhaust portion 63 and the threaded groove spacer outer circumferential portion 64) is arranged in the turbo-molecular pump 100.

The threaded groove spacer threaded groove exhaust portion 63 and the threaded groove spacer outer circumferential portion 64 may be manufactured from different materials, in which case it is preferred that the threaded groove spacer threaded groove exhaust portion 63 be manufactured from a material having a coefficient of thermal conductivity lower than a predetermined value (a resin material, etc.).

In the modification of the second embodiment of the present invention, as described above, the threaded groove exhaust portion of the threaded groove spacer is manufactured from a material having a low coefficient of thermal conductivity.

This configuration of the turbo-molecular pump 100 according to the modification of the second embodiment of the present invention makes it difficult for the heat to be conducted from the threaded groove spacer threaded groove exhaust portion 63 to the threaded groove spacer outer circumferential portion 64. As a result, the decrease in temperature of the threaded groove spacer (the threaded groove spacer threaded groove exhaust portion 63 and the threaded groove spacer outer circumferential portion 64) can be prevented, as well as the deposition and adhesion of products by promoting self-temperature rising of the threaded groove spacer.

In the modification of the second embodiment of the present invention, when an overhaul is executed, it is only necessary to replace the threaded groove spacer threaded groove exhaust portion 63, enabling the execution of an efficient overhaul.

The first and second embodiments of the present invention described above can be modified in various ways as follows.

(ii-3-1) Modification 1 of Each Embodiment

Figure 4:
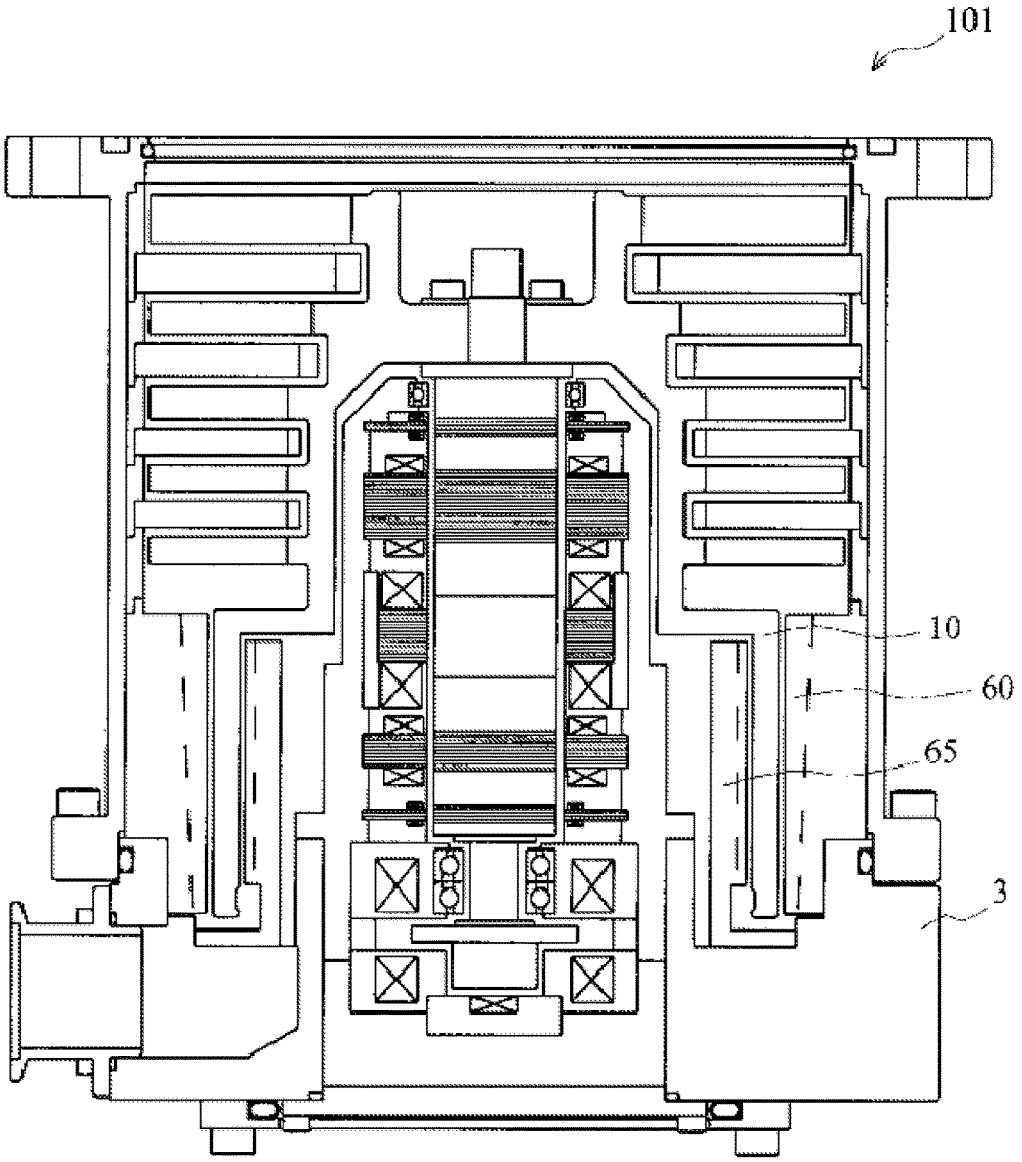
FIG. 4 is a diagram showing an example of the schematic configuration of a turbo-molecular pump according to Modification 1 of each of the embodiments of the present invention.

Next is described, with reference to FIG. 4, a case in which a threaded groove pump unit of a vacuum pump has a folding internal thread portion (a stator-side member of a folding threaded groove pump unit).

FIG. 4 is a diagram showing an example of the schematic configuration of a turbo-molecular pump 101 according to Modification 1 of each of the embodiments of the present invention. Note that FIG. 4 shows a cross-sectional diagram of the turbo-molecular pump 101 along the axial direction and omits the explanation of the configuration same as that of the first embodiment of the present invention.

In the turbo-molecular pump 101 according to Modification 1 of each of the embodiments of the present invention, an internal thread portion 65 is provided on the inside of the tubular rotating member 10 in such a manner as to face an inner circumferential surface of the tubular rotating member 10 with a predetermined clearance therebetween, wherein a part of the internal thread portion 65 that is in contact with the base 3 is folded.

The first and second embodiments described above can be applied to the turbo-molecular pump 101 configured as described above. Note that the internal thread portion 65 may be divided.

(ii-3-2) Modification 2 of Each Embodiment

A configuration of a parallel flow of a threaded groove pump unit of a vacuum pump is described next with reference to FIG. 5.

Figure 5:
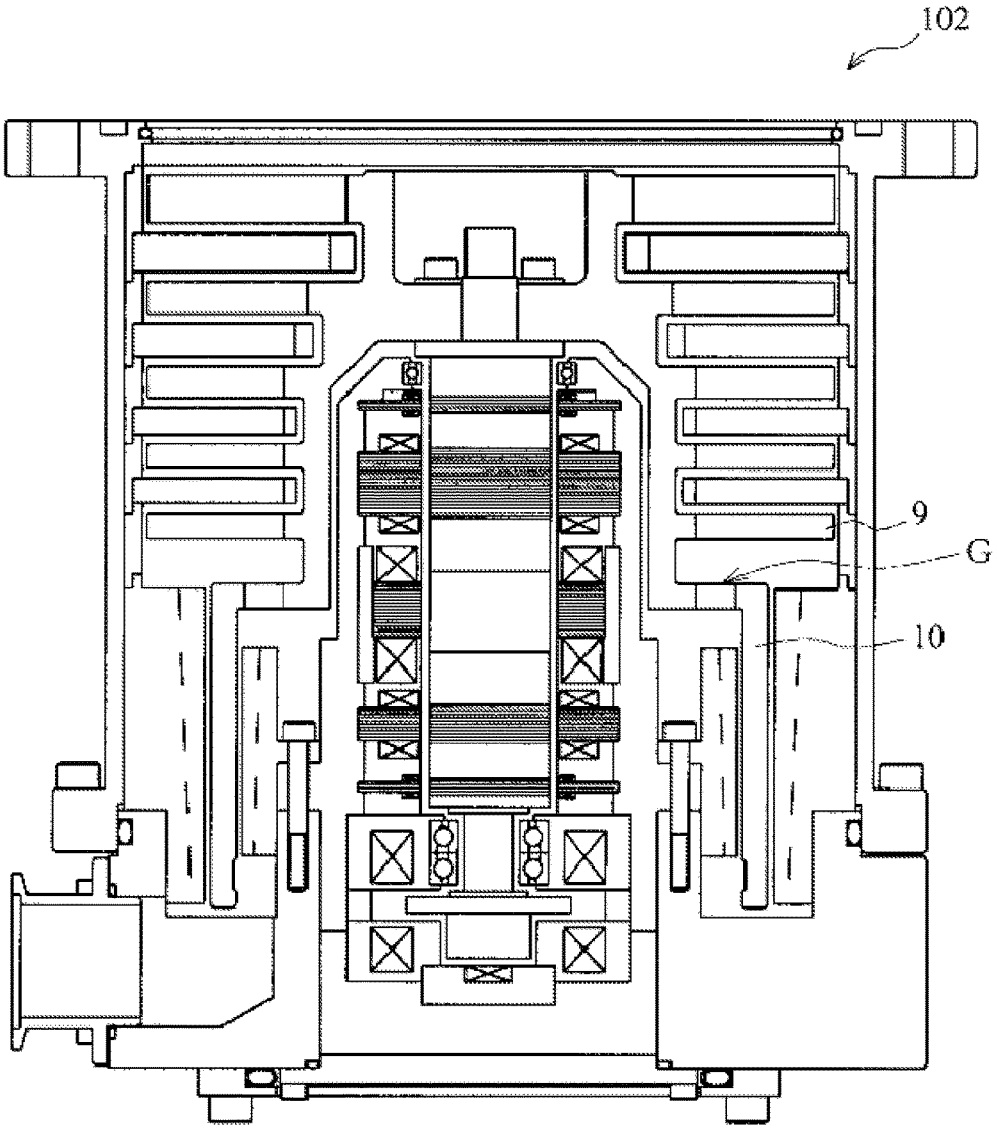
FIG. 5 is a diagram showing an example of the schematic configuration of a turbo-molecular pump according to Modification 2 of each of the embodiments of the present invention.

FIG. 5 is a diagram showing an example of the schematic configuration of a turbo-molecular pump 102 according to Modification 2 of each of the embodiments of the present invention. Note that FIG. 5 shows a cross-sectional diagram of the turbo-molecular pump 102 along the axial direction and omits the explanation of the configuration same as that of the first embodiment of the present invention.

In the turbo-molecular pump 102 according to Modification 2 of each of the embodiments of the present invention, a gap G is provided at a part that opposes the rotor blade 9 at the bottom of the tubular rotating member 10.

The first and second embodiments can be applied to the turbo-molecular pump 102 configured as described above.

(ii-4) Third Embodiment

Next, a case in which a vacuum pump is a threaded groove vacuum pump (i.e., a turbo-molecular pump is not provided, but a threaded groove is provided between an inlet port and an outlet port) is described with reference to FIG. 6.

Figure 6:
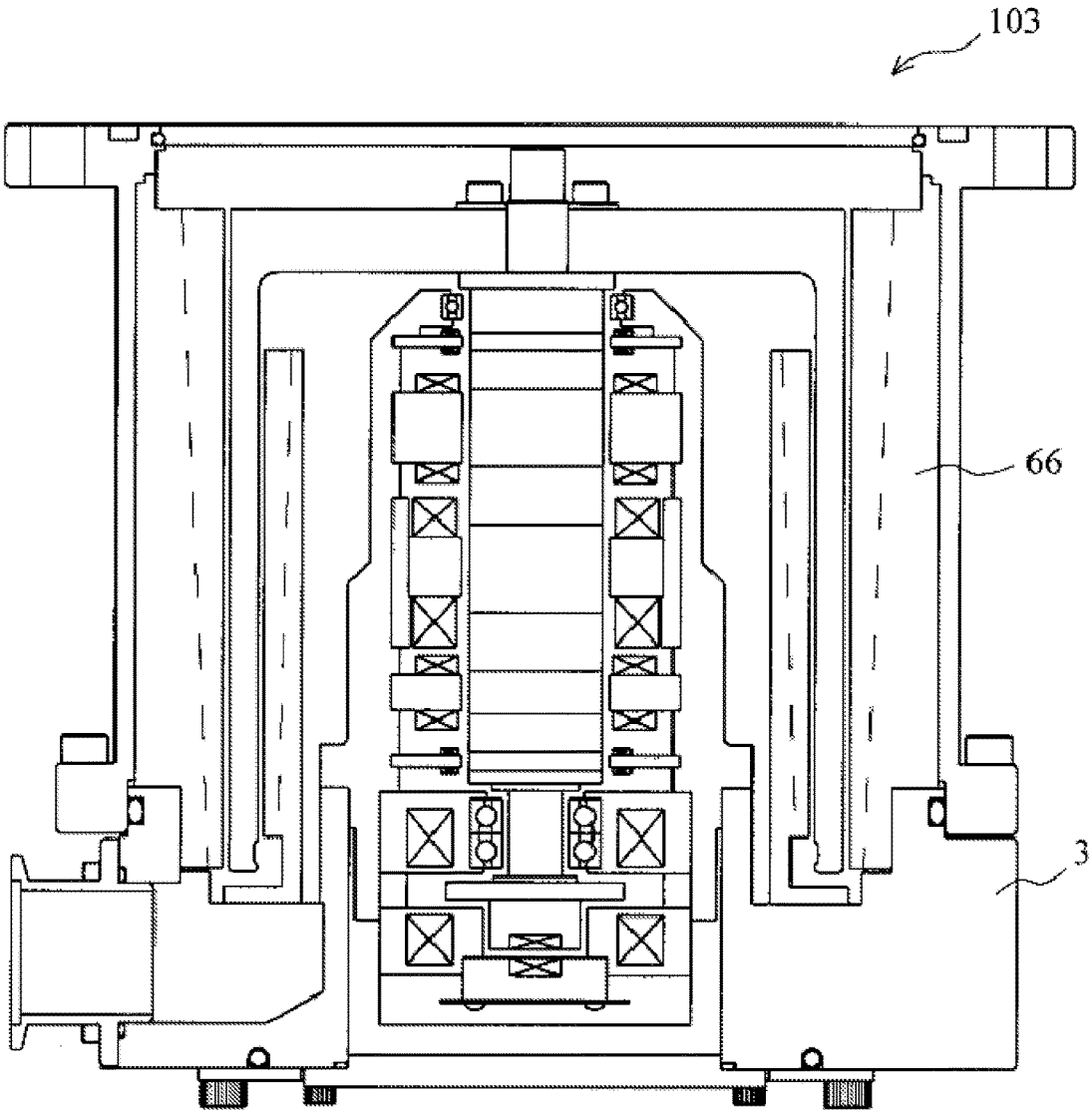
FIG. 6 is a diagram showing an example of the schematic configuration of a threaded groove vacuum pump according to a third embodiment of the present invention.
Figure 7:
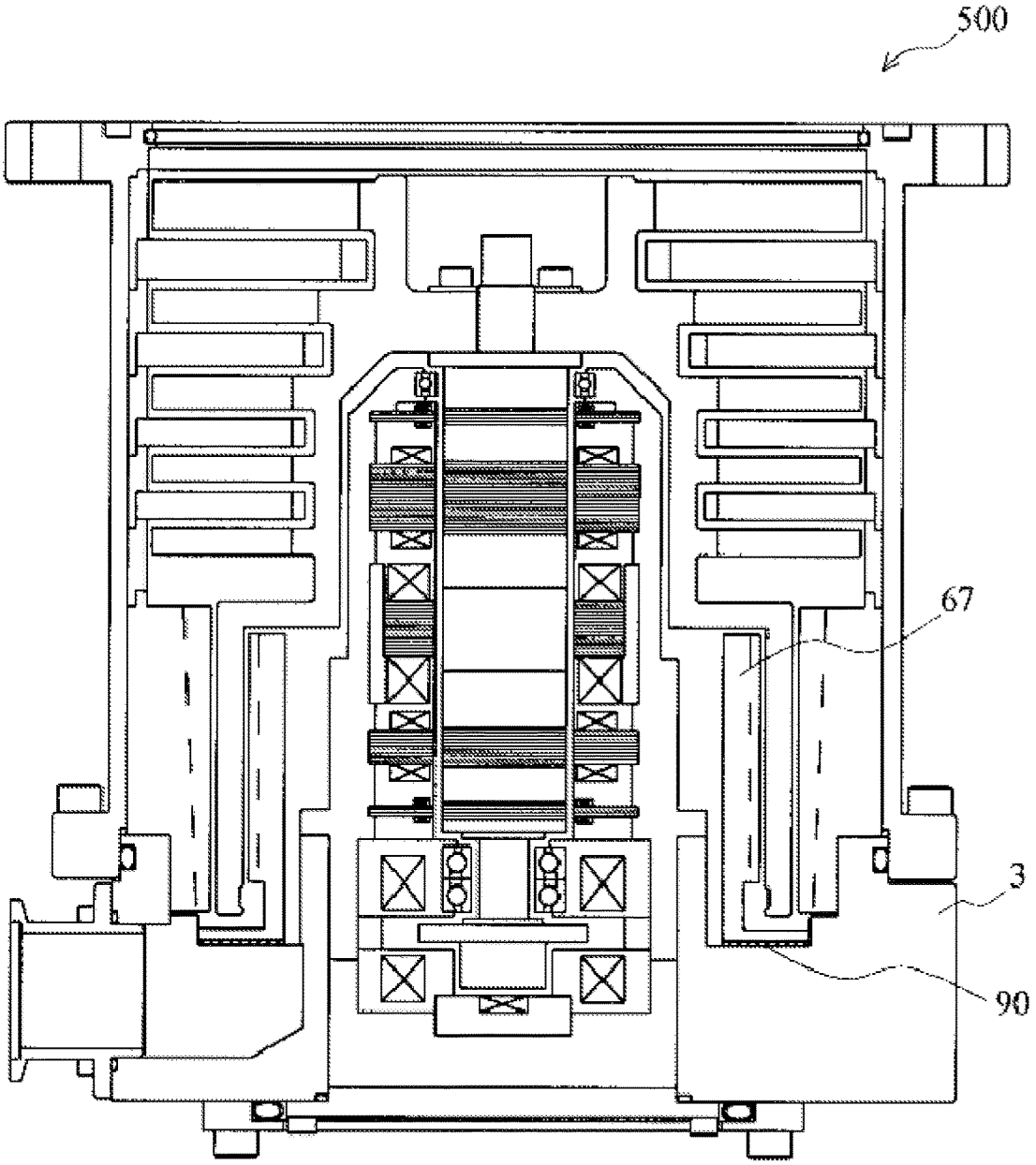
Prior Art FIG. 7
FIG. 7 is a general view for illustrating a conventional technique.

FIG. 6 is a diagram showing an example of the schematic configuration of a threaded groove vacuum pump 103 according to the third embodiment of the present invention, showing a cross-sectional diagram along the axial direction. Note that FIG. 6 shows a cross-sectional diagram of the threaded groove vacuum pump 103 along the axial direction and omits the explanation of the configuration same as that of the first embodiment of the present invention.

The foregoing embodiments and modifications have described a composite turbo-molecular pump as an example of the vacuum pump; however, the present invention can be applied to the threaded groove vacuum pump 103 having a threaded groove spacer 66 shown in FIG. 6.

According to this configuration, the threaded groove vacuum pump 103 according to the third embodiment of the present invention prevents heat from conducting from the threaded groove spacer 66 to the base 3. As a result, the decrease in temperature of the threaded groove spacer 66 can be prevented, as well as the deposition and adhesion of products by promoting self-temperature rising of the threaded groove spacer 66.

The foregoing embodiments and modifications can be combined in a various ways.

According to the present invention, the coefficient of thermal conductivity of the threaded groove spacer arranged in the vacuum pump is lower than a predetermined value. With such a configuration, the present invention can provide a vacuum pump of a stable performance, which, without the provision of a heat insulation material, prevents the deposition of products at the lower side of a threaded groove pump unit, an area of high pressure where the accumulation of deposits occurs easily.

EXPLANATION OF REFERENCE NUMERALS

1: Turbo-molecular pump; 100: Turbo-molecular pump; 101: Turbo-molecular pump; 102: Turbo-molecular pump; 103: Threaded groove vacuum pump; 2: Casing; 3: Base; 4: Inlet port; 5: Flange portion; 6: Outlet port; 7: Shaft; 8: Rotor; 9: Rotor blade; 10: Tubular rotating member; 20: Motor portion; 30: Radial magnetic bearing device; 31: Radial magnetic bearing device; 40: Axial magnetic bearing device; 50: Stator blade; 60: Threaded groove spacer; 61: Threaded groove spacer (divided); 62: Threaded groove spacer (divided); 63: Threaded groove spacer threaded groove exhaust portion (divided); 64: Threaded groove spacer outer circumferential portion (divided); 65: Internal thread portion; 66: Threaded groove spacer; 67: Internal thread portion (conventional); 70: Spacer; 80: Water-cooled pipe; 90: Heat insulation material; 500: Vacuum pump (conventional)

What is claimed is:

1. A stator-side member used in a first gas transfer mechanism of a vacuum pump, the vacuum pump comprising:

a housing in which an inlet port and an outlet port are formed;

a stator portion used in a second gas transfer mechanism of the vacuum pump, the stator portion arranged inside the housing and comprising a plurality of stator blades;

a rotating shaft that is contained in the housing and supported in a rotatable manner; and a rotating body that is fixed to the rotating shaft and which comprises a plurality of rotor blades, wherein the housing comprises a casing and a base, the plurality of stator blades is fixed by a spacer, and the stator-side member is downstream of the plurality of stator blades of the second gas transfer mechanism and is manufactured from a first material being configured to accumulate heat in the stator-side member and having a coefficient of thermal conductivity lower than that of a second material, wherein a part made of the second material comes into contact with the stator-side member, the second material being a material of the base, wherein, during operation of the vacuum pump, a first temperature of the first material is greater than a second temperature of the second material.

2. The stator-side member according to claim 1, wherein the first material is a material having a coefficient of thermal conductivity lower than that of a third material, which opposes the stator-side member, of the rotating body.

3. The stator-side member according to claim 2, wherein the third material is aluminum or aluminum alloy.

4. The stator-side member according to claim 2, wherein the stator-side member is constituted by at least a first stator-side member and a second stator-side member, wherein the first stator-side member comprises a first surface, wherein the second stator-side member comprises a second surface, wherein the first surface is in contact with the second surface.

5. The stator-side member according to claim 4, wherein a part that comes into contact with the second material of at least one of the first stator-side member and the second stator-side member is manufactured from the first material.

6. The stator-side member according to claim 5, wherein a part that opposes the third material of at least one of the first stator-side member and the second stator-side member is manufactured from the first material.

7. The stator-side member according to claim 4, wherein a part that opposes the third material of at least one of the first stator-side member and the second stator-side member is manufactured from the first material.

8. The stator-side member according to claim 1, wherein the first material is stainless steel.

9. The stator-side member according to claim 8, wherein the stator-side member is constituted by at least a first stator-side member and a second stator-side member, wherein the first stator-side member comprises a first surface, wherein the second stator-side member comprises a second surface, wherein the first surface is in contact with the second surface.

10. The stator-side member according to claim 1, wherein the first material is one of polyetherimide and polyetheretherketone.

11. The stator-side member according to claim 1, wherein the first material is fiber-reinforced plastic.

12. The stator-side member according to claim 1, wherein the stator-side member comprises at least a first stator-side member and a second stator-side member, wherein the first stator-side member comprises a first surface, wherein the second stator-side member comprises a second surface, and wherein the first surface is in contact with the second surface.

13. The stator-side member according to claim 12, wherein a part that comes into contact with the second material of at least one of the first stator-side member and the second stator-side member is manufactured from the first material.

14. The stator-side member according to claim 13, wherein a part that opposes the third material of at least one of the first stator-side member and the second stator-side member is manufactured from the first material.

15. The stator-side member according to claim 12, wherein a part that opposes the third material of at least one of the first stator-side member and the second stator-side member is manufactured from the first material.

16. A vacuum pump, comprising:

a housing in which an inlet port and an outlet port are formed;

a stator portion used in a second gas transfer mechanism of the vacuum pump, the stator portion arranged inside the housing and comprising a plurality of stator blades;

a rotating shaft that is contained in the housing and supported in a rotatable manner;

a rotating body that is fixed to the rotating shaft and which comprises a plurality of rotor blades; and a stator-side member that is used in a first gas transfer mechanism, is downstream of the plurality of stator blades of the second gas transfer mechanism and is manufactured from a first material having a coefficient of thermal conductivity lower than that of a second material, wherein a part made of the second material coming into contact with the stator-side member, wherein the housing comprises a casing and a base, the plurality of stator blades is fixed by a spacer, the second material is a material of the base, the first material is configured to accumulate heat in the stator-side member, and during operation of the vacuum pump, a first temperature of the first material is greater than a second temperature of the second material.

17. The vacuum pump according to claim 16, wherein the second gas transfer mechanism transfers a gas suctioned from the inlet port to the outlet port by an interaction between the plurality of rotor blades and the plurality of stator blades.

18. A vacuum pump, comprising:

a housing in which an inlet port and an outlet port are formed;

a stator portion used in a second gas transfer mechanism of the vacuum pump, the stator portion arranged inside the housing and comprising a plurality of stator blades;

a rotating shaft that is contained in the housing and supported in a rotatable manner;

a rotating body that is fixed to the rotating shaft and which comprises a plurality of rotor blades; and a stator-side member that is used in a first gas transfer mechanism, is downstream of the plurality of stator blades of the second gas transfer mechanism and is manufactured from a first material being configured to accumulate heat in the stator-side member and having a coefficient of thermal conductivity lower than that of a second material, wherein a part made of the second material comes into contact with the stator-side member, wherein the housing comprises a casing and a base, the plurality of stator blades is fixed by a spacer, the second material is a material of the base, the coefficient of thermal conductivity of the first material is also lower than that of a third material, which opposes the stator-side member, of the rotating body, and during operation of the vacuum pump, a first temperature of the first material is greater than a second temperature of the second material.

19. The vacuum pump according to claim 18, further comprising the second gas transfer mechanism that has rotor blades arranged radially from an outer circumferential surface of the rotating body and stator blades arranged so as to protrude from an inner side surface of the stator portion toward the rotating shaft, and transfers a gas suctioned from the inlet port to the outlet.

20. A vacuum pump, comprising:

a housing in which an inlet port and an outlet port are formed;

a stator portion used in a second gas transfer mechanism of the vacuum pump, the stator portion arranged inside the housing and comprising a plurality of stator blades;

a rotating shaft that is contained in the housing and supported in a rotatable manner;

a rotating body that is fixed to the rotating shaft and which comprises a plurality of rotor blades; and a stator-side member that is used in a first gas transfer mechanism, is downstream of the plurality of stator blades of the second gas transfer mechanism and is manufactured from a first material being configured to accumulate heat in the stator-side member and having a coefficient of thermal conductivity lower than that of a second material, wherein a part made of the second material comes into contact with the stator-side member, wherein the housing comprises a casing and a base, the plurality of stator blades is fixed by a spacer, the second material is a material of the base, the first material is stainless steel, and during operation of the vacuum pump, a first temperature of the first material is greater than a second temperature of the second material.

* * * * *